United States Patent [19]

Merriman

[11] 4,050,402

[45] Sept. 27, 1977

[54] BURGLAR ALARM FOR DOORS

[76] Inventor: Henry H. Merriman, 751 W. Washington St., Jackson, Mich. 49203

[21] Appl. No.: 701,900

[22] Filed: July 1, 1976

[51] Int. Cl.[2] ..... G08B 13/08

[52] U.S. Cl. ..... 116/86; 92/5 R; 116/65

[58] Field of Search ..... 116/86, 67 R, 100, 85, 116/65, 12; 92/5 R

[56] References Cited

U.S. PATENT DOCUMENTS

| | | | |
|---|---|---|---|
| 1,367,651 | 2/1921 | Ashley | 116/86 |
| 3,618,557 | 11/1971 | Merriman | 116/86 |
| 3,774,572 | 11/1973 | Borraccio | 116/67 R |
| 3,952,688 | 4/1976 | Merriman | 116/67 R |

*Primary Examiner*—S. Clement Swisher
*Assistant Examiner*—Denis E. Corr
*Attorney, Agent, or Firm*—Beaman & Beaman

[57] ABSTRACT

A warning device to discourage the unauthorized entering of doors and windows utilizing a spring contracted bellows held in an extended condition by anchor means associated with building closure structure. Upon the opening of the associated door or window one of the anchor means is released permitting the bellows to be rapidly contracted producing an audible sound by means of a vibratable reed to warn the occupant and discourage the intruder from further entry.

8 Claims, 8 Drawing Figures

BURGLAR ALARM FOR DOORS

BACKGROUND OF THE INVENTION

The invention pertains to warning devices of the unauthorized entry type utilizing compressed air to produce an audible signal upon the opening of a building closure.

With the present high crime rate, much concern has been expressed as to the unauthorized entry of buildings and motel and hotel rooms for the purpose of theft or assault. A number of safety devices have been proposed for preventing unauthorized entrance through doors and windows and such devices take the form of latches, locks, clasps, props, signals, etc. Of particular concern to the traveler has been the possibility of unauthorized entrance to occupied motel and hotel rooms.

The majority of burglar warning and deterring devices are of the passive type, i.e., are silent in operation and consist of locks, tamper-proofing devices, and the like. However, it is known to utilize active burglar alarm systems wherein audible and visual indicators are used to warn of the intrusion. Of course, burglar alarm systems for commercial buildings wherein police departments are automatically alerted are well known and smaller units have also been proposed for producing a warning signal of a localized nature, as shown by my U.S. Pat. No. 3,618,557.

In my aforementioned patent a bellows device is used to activate a vibratable reed upon the unauthorized opening of a building closure. The energy supplied to activate the device is that energy used to open the closure and, if the closure is very slowly opened, it is possible to prevent the signal from occurring or being produced in sufficient volume to be an effective warning. Other burglar warning devices which have been proposed rely upon batteries, and electric power sources which may be purposely rendered inoperative, or over a period of time deplete their energy and become inoperative and, to my knowledge, an effective self-powered burglar alarm is not available on the market which fully meets the desired criteria of such a device.

SUMMARY OF THE INVENTION

It is an object of the invention to provide a burglar alarm of the self-energized and powered type wherein the unauthorized opening of a building closure, such as a door or window, results in the producing of loud noise capable of alerting the building occupant and frightening away the intruder.

Another object of the invention is to provide a spring-powered burglar alarm which is of a simplified and economical construction, of light weight and compact configuration as to be readily packed in a suitcase and which may be universally used with all types of doors and windows.

In the practice of the invention, an elongated bellows is employed having an anchor located at each end thereof. A tension spring is utilized to bias the bellows toward its contracted condition and one of the anchors is attached to a movable portion of the door or window, such as the doorknob, while the other anchor is associated with door or window structure as to sense movement thereof during opening. Upon the bellows anchors being "set" the bellows is stretched to an extended condition, tensioning the spring, and when the closure is opened an anchor is released and contracts the bellows forcing air through an air passage in which a vibratable reed is located. Air movement past the reed results in an audible signal which is of considerable volume.

Preferably, one of the anchors is in the form of a loop as to be slipped over a doorknob and the other anchor included an elastic band and a flat rigid member which may be inserted between the edge of a door or window and the adjacent jamb.

The ends of the bellows are closed by cylindrical heads in which an air passage and vibratable reed apparatus is located and the nature of the apparatus is such that all of its components may be readily manufactured from low-cost components on a high production basis. For safety purposes a flexible cup is employed to receive the door anchor during release.

BRIEF DESCRIPTION OF THE DRAWINGS

The aforementioned objects and adavntages of the invention will be appreciated from the following description and accompanying drawings wherein.

DESCRIPTION OF THE PREFERRED EMBODIMENT

Figure 4:
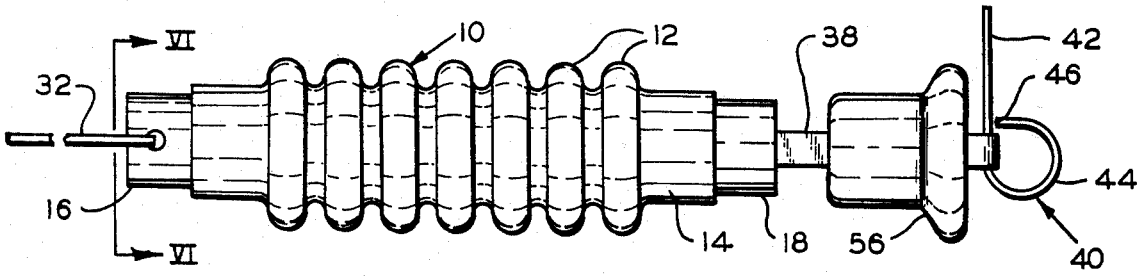
FIG. 4 is an elevational view of the burglar alarm in accord with the invention shown in a substantially contracted condition.
Figure 5:
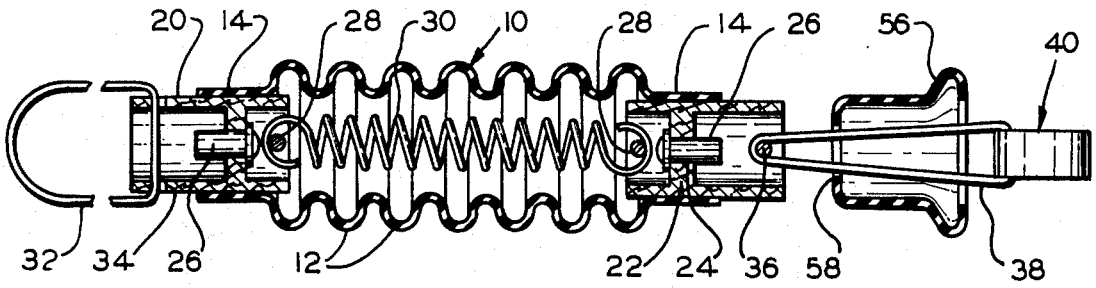
FIG. 5 is an elevational diametrical sectional view of the burglar alarm.

The apparatus of the alarm in accord with the invention is best understood from FIGS. 4 and 5. As will be apparent, the primary component consists of an elongated tubular bellows 10 formed of a flexible resilient material such as rubber, or the like. The bellows central region includes a plurality of annular ribs or corrugations 12 and each end region 14 is of a cylindrical tubular shape for cooperation with the heads 16 and 18.

The heads 16 and 18 are of a similar construction, formed of any acceptable material, such as metal, plastic or wood, including an outer cylindrical surface 20 upon which the bellows end regions 14 are received and, if desired, may be bonded thereto with an appropriate adhesive. The heads each include a radial web 22 in which an air passage 24 is defined therethrough. In each air passage a vibratable reed device 26 is mounted wherein the flow of air from the interior of the bellows outwardly to the atmosphere through the reed device will produce an audible sound.

Each of the heads includes an anchor spring pin 28 diametrically mounted therein and a tension coil spring 30 is located within the bellows wherein each end thereof is associated with a pin 28, and the nonextended length of the spring is such that the corrugations 12 substantially engage each other when the spring is at rest.

An anchor is associated with each head, as apparent from the drawings, one of the anchors may consist of a loop 32 formed of a cord or leather thong. The diameter of the loop is sufficient to permit the same to be slipped over a conventional door knob. Holes 34 are formed in the head 16 to permit attachment of the loop to the head.

The head 18 includes a diametrical anchor pin 36 upon which the elastic band 38 is mounted. The elastic band is similar to an oversize rubber band and an anchor member 40 is attached to the band. The anchor member 40 is relatively rigid in construction, being formed of metal or plastic, and includes a flat thin portion 42 which may be inserted between the edge of a door and the adjacent jamb. An eye portion 44 bent back upon itself includes an end 46 disposed adjacent the flat portion 42, but spaced therefrom a distance less than the normal "thickness" of the band 38. Thus, member 40 will be positively associated with the band during storage, handling and operation. The band 38 is assembled to the member 40 by stretching the band prior to being inserted "under" the end 46. Such stretching reduces the "thickness" of the band and permits the band to enter the eye portion 44.

Figure 1:
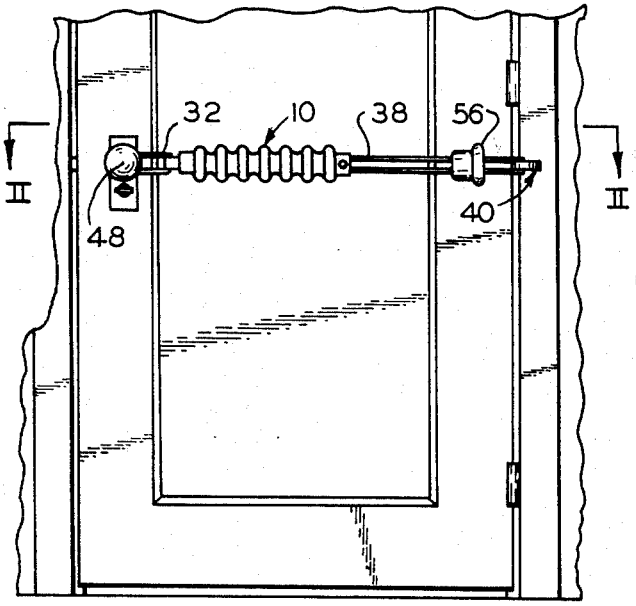
FIG. 1 is a partial elevational view of a closed door with the burglar alarm of the invention mounted thereon in the extended condition.
Figure 2:
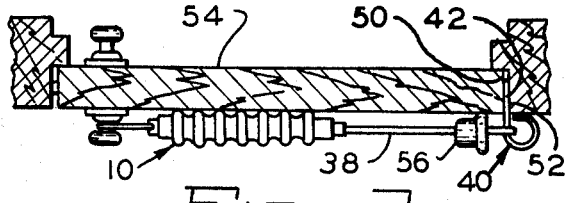
FIG. 2 is a sectional plan view of FIG. 1 as taken along section II—II thereof.
Figure 3:
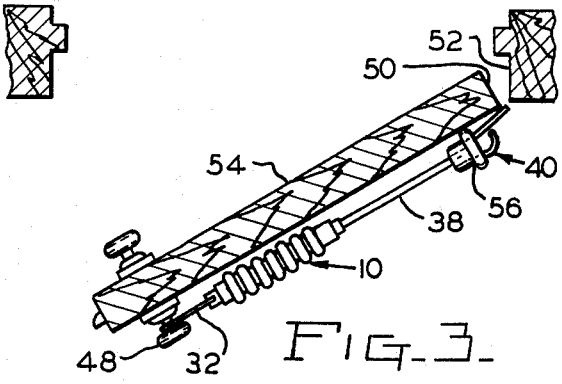
FIG. 3 is a sectional view similar to FIG. 2 illustrating the door in a partially opened condition and after the flat anchor has been released.
Figure 6:
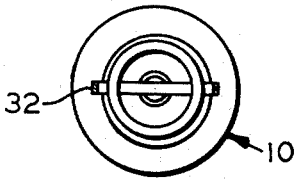
FIG. 6 is an end elevational view as taken along section VI—VI of FIG. 4.
Figure 7:
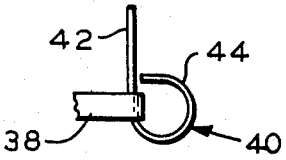
FIG. 7 is a detailed view of the flat member anchor as taken from above.
Figure 8:
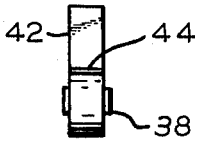
FIG. 8 is a view of FIG. 7 as taken from the right thereof.

In use, the loop 32 is slipped over a doorknob 48 as shown in FIGS. 1 through 3. Thereupon, the portion 42 of member 40 is inserted into the crack between the door edge 50 and doorjamb 52 as shown in FIG. 2. The length of the bellows 10 and band 38 is such that the bellows and band must be extended to permit member 40 to be inserted into the crack of the door and such extension also tensions the spring 30.

The thin portion 42 of member 40 is of sufficient length so that the force acting thereon, due to the extension of the spring 30 and the band 38, will not pull the member 40 from between the door edge and doorjamb. Of course, the forces acting upon the member 40 are at right angles to the plane of the portion 42 and, thus, a bending force is exerted on the member.

In the event that the door 54 is partially opened, the spacing between the door edge 50 and the doorjamb 52 increases and only a limited opening of the door is necessary to permit the member 40 to be pulled from the door crack. At such time, the spring 30 quickly contracts the bellows 10 rapidly expelling the air from the within the bellows through the reed devices 26 producing a loud noise. The resultant noise is sufficient to awaken most sleeping room occupants and, in fact, can be heard throughout most of the rooms on the same floor level of a conventional size house. Also, the resultant noise is somewhat similar to the noise a dog might make when startled and it is likely that the intruder will mistake the signal for the presence of a dog and flee.

In the illustrated embodiment a safety cup 56 formed of soft molded rubber or polyvinyl is mounted on the band 38 to receive the anchor member 40, FIG. 3, when the bellows and band contract to prevent possible injury by the moving member. The cup 58 includes a base 58 which has an opening for receiving band 38, and the cup does not interfere with the alarm operation.

As the contracted dimensions and configurations of the burglar alarm are such that the device may be easily packed in a suitcase, the apparatus is convenient for use during travel and its construction readily permits use with all types of doors and windows. When the apparatus is used with a window, it may not be necessary to use the member 40 but the window may be lowered upon the band 38 itself, while the loop 32 is affixed to a stationary member. Also, it will be appreciated that, when used with a door, it would be possible to attach the loop 32 to other room structure than the doorknob and yet permit the device to function in the afoementioned manner. It is only necessary that the bellows be extended and the spring be tensioned and one of the anchors be related to the door to sense door opening and release when the door is opened. Also, while the disclosed embodiment illustrates the use of two vibratable reeds, one in each head, a single reed device may be employed, but two reed devices are preferred in that the intensity of the signal is greater.

It is appreciated that various modifications to the invention may be apparent to those skilled in the art without departing from the spirit and scope thereof.

I claim:

1. A burglar alarm for indicating the opening of a building closure comprising, in combination, an elongated bellows having an axis, first and second ends and expansible and contractable in its axial direction, a tension spring within said bellows having first and second ends, said first spring end being affixed to said bellows' first end and said second spring end being affixed to said bellow' second end whereby said spring biases said bellows toward its connected condition, an air passage communicating with the interior of said bellows, a vibratable read within said air passage producing an audible signal during movement of said member from the expanded condition to the contracted condition, first anchor means defined upon said first end, and second anchor means defined on said second end.

2. In a burglar alarm as in claim 1 wherein said first anchor means comprises a loop and said second anchor means includes a rigid flat member insertable between the edge of a door and a doorjamb.

3. A burglar alarm for indicating the opening of a building closure comprising, in combination, an elongated bellows having an axis and first and second ends, a head mounted in each bellows end closing the associated end, a tension spring within said bellows having an end affixed to each head biasing said bellows toward a contracted condition, an air passage defined in at least one of said heads communicating with interior of said bellows, a vibratable reed within said air passage producing an audible signal upon air flowing therethrough during contracting of said bellows, and an anchor means defined upon said heads whereby said anchor means may be associated with closure structure to maintain said bellows in an extended condition.

4. In a burglar alarm as in claim 3 wherein an air passage is defined in each head having a vibratable reed therein.

5. In a burglar alarm as in claim 3 wherein one of said anchor means includes a loop of sufficient dimensions to encompass a doorknob, and the other anchor means includes a rigid flat member insertable between the edge of a door and the doorjamb.

6. In a burglar alarm as in claim 5 wherein at least one of said anchor means includes a resilient band.

7. In a burglar alarm as in claim 6 wherein said rigid flat member includes an eye having a bent end portion terminating short of a flat portion, said resilient band being received within said eye and said band being of a normal untensioned thickness greater than the opening between said bent end portion and flat portion, tensioning of said band reducing its thickness permitting band insertion into said eye.

8. In a burglar alarm as in claim 7, a flexible cup mounted upon said band having an open end disposed toward said rigid flat member receiving said member during contraction of said bellows and band.

* * * * *